US008684481B2

(12) United States Patent
Tanizaki et al.

(10) Patent No.: US 8,684,481 B2
(45) Date of Patent: Apr. 1, 2014

(54) PRINTER

(71) Applicant: Brother Kogyo Kabushiki Kaisha, Nagoya (JP)

(72) Inventors: Masashi Tanizaki, Nagoya (JP); Yuichiro Suzuki, Nagoya (JP); Takahiro Miwa, Nagoya (JP)

(73) Assignee: Brother Kogyo Kabushiki Kaisha, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 13/718,341

(22) Filed: Dec. 18, 2012

(65) Prior Publication Data

US 2013/0169728 A1 Jul. 4, 2013

(30) Foreign Application Priority Data

Dec. 26, 2011 (JP) ..... 2011-284058

(51) Int. Cl.
*B41J 29/38* (2006.01)

(52) U.S. Cl.
USPC ..... 347/5

(58) Field of Classification Search
None
See application file for complete search history.

(56) References Cited

U.S. PATENT DOCUMENTS

| | | | | |
|---|---|---|---|---|
| 7,014,375 | B2 | 3/2006 | Nagae et al. | |
| 2009/0041527 | A1 * | 2/2009 | Ohashi et al. | 400/613 |

FOREIGN PATENT DOCUMENTS

| | | |
|---|---|---|
| JP | 2002-59581 | 2/2002 |
| JP | 2002-335637 | 11/2002 |
| JP | 2005-74768 | 3/2005 |

* cited by examiner

*Primary Examiner* — Matthew Luu
*Assistant Examiner* — Erica Lin
(74) *Attorney, Agent, or Firm* — McCarter & English, LLP

(57) ABSTRACT

This disclosure discloses a printer comprising a feeder, a thermal head, an energizing device configured to selectively energize heating elements of the thermal head, a driving device configured to control a driving of the feeder, a battery storage part, a voltage detecting device configured to detect an output voltage value of the battery, a display device, and a control device. The control device executes a dot count identification process where a dot count is identified at a first timing and a second timing, a dot voltage fluctuation value calculation process where a voltage fluctuation value per dot is calculated, a maximum load voltage estimation process where a voltage value of the battery is estimated at a time equivalent to maximum load, a consumption level determination process where a consumption level of the battery is determined, and a display process where a predetermined display is executed on the display device.

5 Claims, 11 Drawing Sheets

61
62
62
HIGH
(CONSUMPTION LEVEL: LOW)
MEDIUM
(CONSUMPTION LEVEL: MEDIUM))
LOW
(CONSUMPTION LEVEL: HIGH)
DISPLAY OF AMOUNT OF REMAINING BATTERY POWER
REMAINING BATTERY POWER

FIG. 12

| | VA [V] | Th4 [V] | Th5 [V] | VB [V] |
|---|---|---|---|---|
| ALKALINE MANGANESE DIOXIDE BATTERY | 7. 75 | 7. 00 | 6. 25 | 5. 50 |
| NICKEL-METAL HYDRIDE BATTERY | 6. 55 | 6. 35 | 6. 15 | 5. 95 |

PRINTER

CROSS-REFERENCE TO RELATED APPLICATION

The present application claims priority from Japanese Patent Application No. 2011-284058, which was filed on Dec. 26, 2011, the disclosure of which is incorporated herein by reference in its entirety.

BACKGROUND

1. Field

The present disclosure relates to a printer driven by a battery.

2. Description of the Related Art

Until now, there has previously been proposed a printer that operates using a battery, ensuring easy use by a user, for example. In this case, the battery is consumed with repeated use, increasing internal resistance. Accordingly, whether or not a battery has been consumed can be identified by the change (decrease) in the output voltage value over time. There is a prior art that focuses on this point. According to this prior art, the battery voltage is detected in both a state where power is not supplied and no load is imposed from the battery to the print head, motor, etc., and a state where power is supplied and a load is imposed from the battery to the print head, motor, etc. The consumption state of the mounted battery at that time is then determined based on the voltage drop between these two states.

Nevertheless, in the above prior art, the voltage drop is calculated by only two voltage values, the output voltage value of the battery in a state where a load is not imposed and the output voltage value of the battery in a state where a load is imposed, and the consumption state of the battery is determined by this voltage drop. Accordingly, the consumption level of the battery (in other words, the amount of remaining battery power) cannot be determined with high accuracy. As a result, the operator cannot accurately recognize the amount of remaining battery power, causing inconvenience.

SUMMARY

It is therefore an object of the present disclosure to provide a printer capable of determining the consumption level of a battery with high accuracy, making the operator accurately and reliably aware of the amount of remaining battery power.

In order to achieve above-described object, according to the aspect of the present application, there is provided a printer comprising a feeder configured to feed a print-receiving object, a thermal head comprising a plurality of heating elements configured to form dots on each print line where the print-receiving object is divided into print resolutions in a feed direction, an energizing device configured to selectively energize the plurality of heating elements of the thermal head in accordance with print data, a driving device configured to control a driving of the feeder, a battery storage part configured to store a battery configured to supply power to the energizing device and the driving device, a voltage detecting device configured to detect an output voltage value of the battery, a display device, and a control device configured to control the energizing device and the driving device so that the thermal head forms print corresponding to the print data on the print-receiving object fed by the feeder, generating a printed object. The control device executes a dot count identification process where a dot count, which is a number of the plurality of heating elements simultaneously energized by the energizing device, is identified at a first timing to provide a relatively high dot count and a second timing to provide a relatively low dot count, in a predetermined time range during generation of a single printed object via coordination of the feeder and the thermal head, a dot voltage fluctuation value calculation process where a voltage fluctuation value per dot is calculated by dividing a difference between the output voltage value detected by the voltage detecting device at the first timing and the output voltage value detected by the voltage detecting device at the second timing by a difference between the dot count identified by the dot count identification process at the first timing and the dot count identified by the dot count identification process at the second timing, a maximum load voltage estimation process where a voltage value of the battery is estimated at a time equivalent to maximum load for the energizing device and the driving device, based on the voltage fluctuation value per dot calculated by the dot voltage fluctuation value calculation process, the output voltage value at the first timing, and the output voltage value at the second timing, a consumption level determination process where a consumption level of the battery is determined based on a comparison result of a voltage value at the time equivalent to maximum load estimated by the maximum load voltage estimation process and a consumption level determination threshold value determined in advance, and a display process where a predetermined display indicating a consumption level in stages is executed on the display device, based on a determination result of the consumption level determination process.

In the present disclosure, dots are formed by a plurality of heating elements of a thermal head on a print-receiving object fed by a feeder, thereby forming print corresponding to print data and generating a printed object. The heating elements are energized by an energizing device, thereby forming the print, and the feeder is driven by a driving device to perform the feeding. The power to the energizing device and driving device is supplied by a battery stored in a battery storage part.

Here, in the present disclosure, a voltage detecting device is provided, detecting the voltage value of the output terminal of the battery. When a single printed object is generated as previously described, the voltage value of the output terminal changes during that generation. That is, when the plurality of heating elements of the thermal head is energized to perform printing on the print-receiving object while feeding is performed by the feeder, the load relatively increases at a timing when there is a large number of heating elements energized (in other words, when there is a large number of dots to be formed) in correspondence with the print data, causing the output voltage value of the battery to decrease. Conversely, the load decreases at a timing when there is a small number of heating elements energized (in other words, when there is a small number of dots to be formed), causing the output voltage value of the battery to increase. The degree of fluctuation in the output voltage value caused by the magnitude of this dot count (that is, the output voltage fluctuation value per dot) differs according to the consumption level of the battery.

Here, in the present disclosure, there are provided a dot count identifying process, a dot voltage fluctuation value calculating process, and a consumption level determining process. When the dot count identifying process identifies the dot count at a first timing and a second timing during the generation of a single printed object, the dot voltage fluctuation value calculating process divides the difference between the output voltage values at these two timings by the difference between the dot counts of the two timing, thereby calculating the voltage fluctuation value per dot.

At this time, this voltage fluctuation value per dot expresses the correlation between the dot count to be energized by the thermal head and the voltage value of the output terminal of the battery. According to the present disclosure, a maximum load voltage estimating process estimates the voltage value of the battery at a time equivalent to maximum load using this correlation. As previously described, the consumption level of the battery is higher with a lower voltage value per dot (higher absolute value of the negative value), and lower with a higher voltage value per dot (lower absolute value of the negative value). With this arrangement, a suitable consumption level determination threshold value corresponding to the above behavior is set in advance, making it possible for the consumption level determining process to compare the consumption level determination threshold value and the voltage value at the time equivalent to maximum load, and determine the consumption level of the battery with high accuracy. Then, a display device executes a predetermined display indicating the consumption level in stages in correspondence with this determination.

As described above, the present disclosure is capable of determining the consumption level of a battery with high accuracy using the degree of fluctuation of the output voltage value when a printed object is actually generated with a relatively high load applied (the output voltage fluctuation value per dot), and displaying the consumption level with high accuracy. With this arrangement, it is possible to make the operator accurately and reliably aware of the current amount of remaining battery power and, in a case where the consumption level is high, accurately and reliably aware of the timing when battery replacement is required.

BRIEF DESCRIPTION OF THE DRAWINGS

FIG. 12 is a table showing numerical examples of the maximum voltage value, minimum voltage value, and two consumption level determination threshold values of an alkaline manganese dioxide battery and a nickel-metal hydride battery.

DETAILED DESCRIPTION OF PREFERRED EMBODIMENTS

The following describes one embodiment of the present disclosure with reference to accompanying drawings. This embodiment applies the present disclosure to a print label producing apparatus serving as a printer. This print label producing apparatus produces print labels (refer to FIG. 5 described later) as printed objects by performing preferred printing and cutting the label tape with print at a predetermined length.

General Configuration of Print Label Producing Apparatus

First, the general configuration of this print label producing apparatus will be described with reference to FIGS. 1-3. In the embodiment, the terms front, rear, left, right, up, and down of the print label producing apparatus indicate the directions shown in FIG. 1, FIG. 2, etc.

Figure 1:
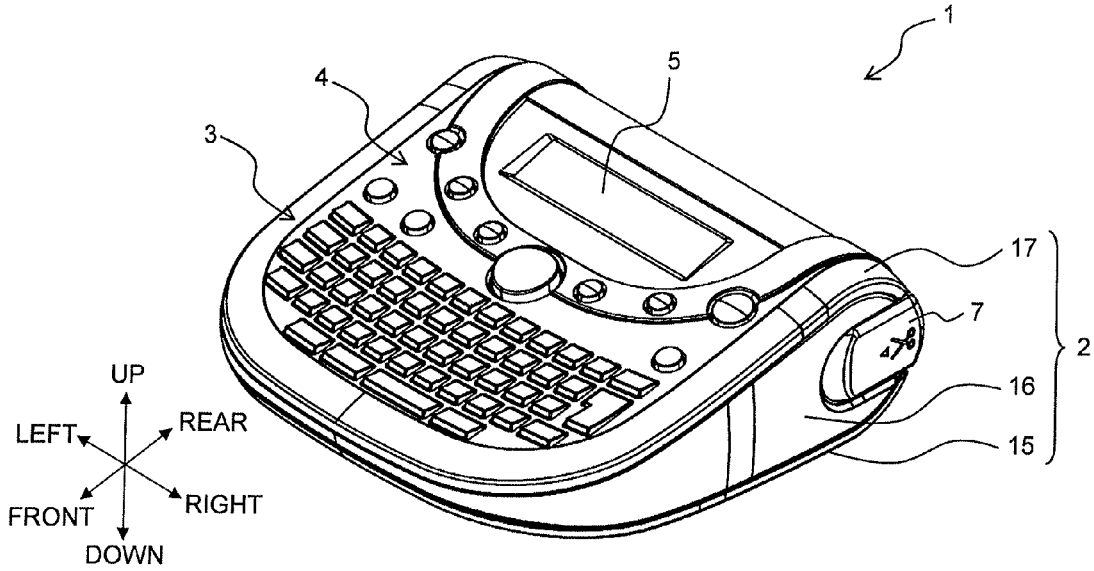
FIG. 1 is a perspective view showing the outer appearance of the print label producing apparatus according to an embodiment of the present disclosure, as viewed obliquely from above.
Figure 2:
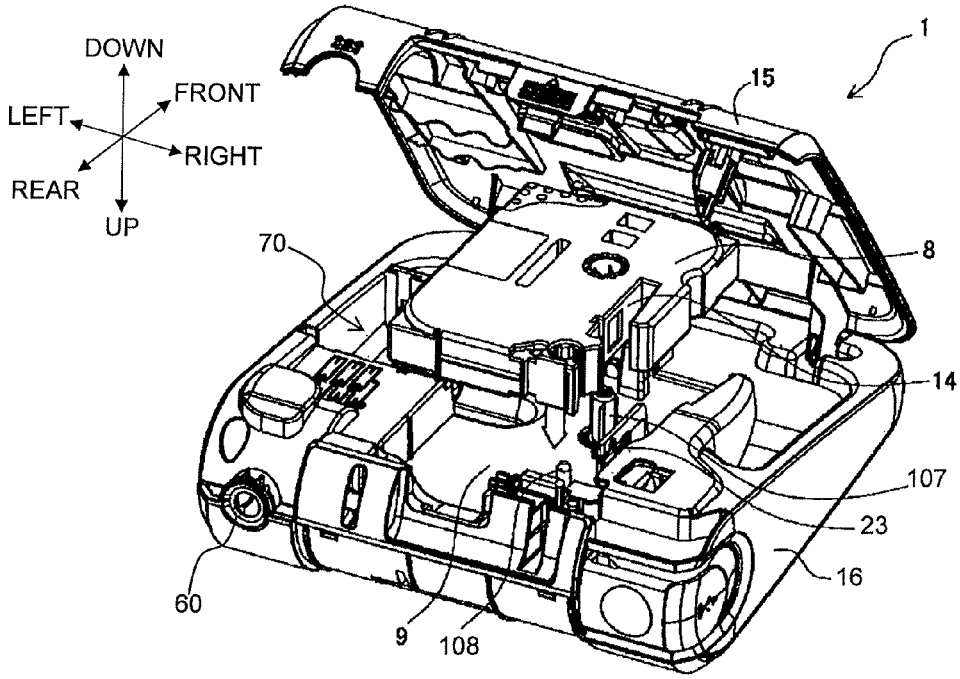
FIG. 2 is a perspective view showing the outer appearance of the print label producing apparatus with the lower cover open, as viewed obliquely from below.

As shown in FIG. 1 and FIG. 2, a housing 2 of a print label producing apparatus 1 comprises a lower cover 15 constituting the apparatus lower surface, a side cover 16 constituting the apparatus side surface, and an upper cover 17 constituting the apparatus upper surface. The upper cover 17 is provided with a keyboard 3 by which various operations, such as character input, etc., are performed, a function key group 4 for executing various functions of the print label producing apparatus 1, such as a power switch, print key, etc., and a liquid crystal display 5 for displaying input characters, symbols, and the like, in that order from the front toward the rear. Further, a cutter lever 7 for cutting a print label tape 109 with print (refer to FIG. 3) is provided rearward from and on the right side of the side cover 16.

A cartridge holder 9 capable of attaching and detaching a cartridge 8 is provided rearward from and on the lower side of the print label producing apparatus 1. This cartridge holder 9 is covered when the above described lower cover 15 configured in an openable and closeable manner with the front end of the print label producing apparatus 1 serving as the axis of rotation is closed, and is exposed when the lower cover 15 is opened.

Figure 3:
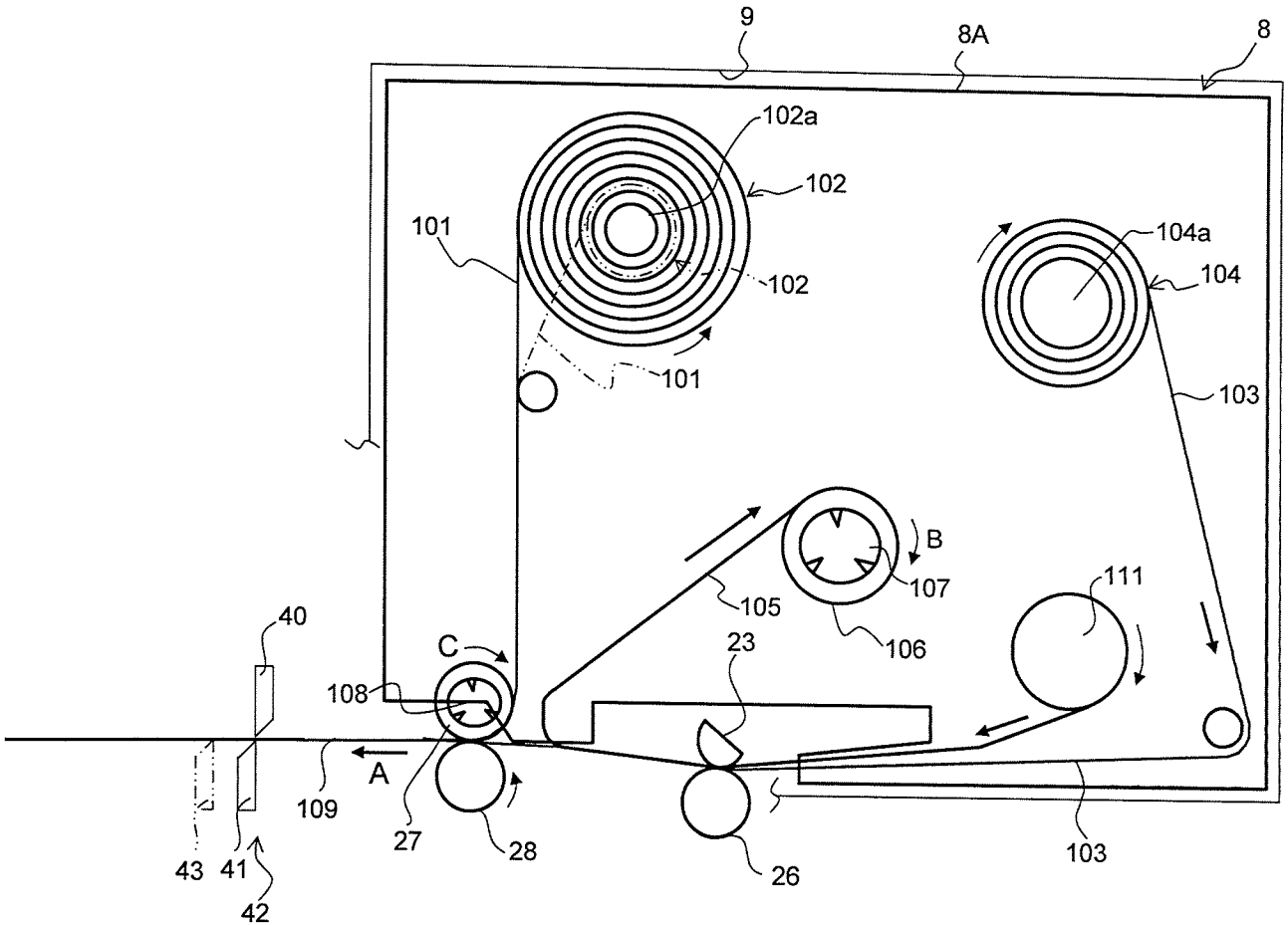
FIG. 3 is an enlarged plan view schematically showing the inner structure of a cartridge.

As shown in FIG. 3, the cartridge 8 comprises a housing 8A, a first roll 102 (actually spiral in shape, but simply shown in a concentric shape in the figure), around which a strip base tape 101 is wound, and which is disposed within the housing 8A, a second roll 104 (actually spiral in shape, but simply shown in a concentric shape in the figure), around which a transparent cover film 103 is wound, with approximately the same width as that of the above described base tape 101, a ribbon supply side roll 111 configured to feed out an ink ribbon 105 (heat transfer ribbon, which is not required in a case of employing a thermal tape as the print-receiving tape), a ribbon take-up roller 106 configured to rewind the ribbon 105 after the printing, and the feeding roller 27 rotatably supported near a tape discharging part of the cartridge 8.

The feeding roller 27 is configured to adhere the above described base tape 101 and the above described cover film 103 to each other by applying pressure and feed the above described label tape 109 with print thus formed in the direction of the arrow A in FIG. 3 (functioning as a pressure roller as well).

The first roll 102 has the above described base tape 101 wound around a reel member 102*a*. Although not shown in detail, the base tape 101, in this example, has a four-layer structure comprising a bonding adhesive layer made of a suitable adhesive, a colored base film made of PET (polyethylene terephthalate) or the like, a bonding adhesive layer made of a suitable adhesive, and a separation sheet, which are layered in that order from the side rolled to the inside of the first roll 102 to the opposite side.

The second roll 104 has the above described cover film 103 wound around a reel member 104*a*. On the rear surface of the cover film 103 fed out from the second roll 104, the ink ribbon 105 is pressed against and made to contact a thermal head 23.

At this time, in accordance with the configuration of the above described cartridge 8, the cartridge holder 9 is provided with a ribbon take-up roller driving shaft 107 for rewinding the above described used ink ribbon 105, and a feeding roller driving shaft 108 for driving the feeding roller 27 (refer to FIG. 3) for feeding the label tape 109 with print. Further, the thermal head 23 that performs preferred printing on the cover film 103 is provided to the cartridge holder 9 so that it is positioned at an opening 14 thereof when the cartridge 8 is mounted.

The ribbon take-up roller 106 and the feeding roller 27 are respectively rotationally driven in coordination by the driving force of a drive motor 211 (refer to FIG. 4 described later), which is a pulse motor, for example, provided on the outside of the cartridge 8, that is transmitted to the above described ribbon take-up roller driving shaft 107 and the above described feeding roller driving shaft 108 via a gear mechanism (not shown).

In the above described configuration, when the cartridge 8 is mounted to the above described cartridge holder 9 and a roller holder is moved from a release position to a printing position, the cover film 103 and the ink ribbon 105 are held between the above described thermal head 23 and a platen roller 26 provided facing this thermal head 23. With this, the base tape 101 and the cover film 103 are held between the feeding roller 27 and a pressure roller 28 provided facing the feeding roller 27. Then, the ribbon take-up roller 106 and the feeding roller 27 are synchronously rotationally driven along the directions denoted by arrow B and arrow C, respectively, in FIG. 3 by the driving force of the above described drive motor. Furthermore, the aforementioned feeding roller driving shaft 108, the above described pressure roller 28, and the platen roller 26 are connected to one another by a gear mechanism (not shown). With such an arrangement, with the driving of the feeding roller driving shaft 108, the feeding roller 27, the pressure roller 28, and the platen roller 26 rotate, thereby feeding out and supplying the base tape 101 from the first roll 102 to the feeding roller 27 as previously described. On the other hand, the cover film 103 is fed out from the second roll 104, and the plurality of heating elements provided to the thermal head 23 is selectively energized to generate heat in accordance with print data of preferred print contents by a thermal head control circuit 217 (refer to FIG. 4 described later). At this time, on the rear surface side of the cover film 103 (that is, the side to be adhered with the above described base tape), the ink ribbon 105 driven by the ribbon take-up roller 106 is pressed and made to contact the above described print head 23. With this arrangement, on the rear surface of the cover film 103, dots are respectively formed on each of the print lines that divide the cover film 103 in terms of print resolution in the feed direction, and print corresponding to the above described print data is printed. Then, the above described base tape 101 and the cover film 103 on which the above described printing is completed are adhered and integrated by the above described bonding adhesive layer by the pressing of the above described feeding roller 27 and the pressure roller 28. The label tape 109 with print formed by this bonding is discharged to the outside of the cartridge 8. The ribbon take-up roller driving shaft 107 is driven to rewind the ink ribbon 105, which has been used to print the print on the cover film 103, onto the ribbon take-up roller 106.

A cutting mechanism 42 comprising a fixed blade 40 and a moveable blade 41 is provided to the downstream side of the transport path of the label tape 109 with print discharged to the outside of the cartridge 8. The movable blade 41 operates when the above described cutter lever 7 is operated, cutting the above described label tape 109 with print, thereby generating the print label L (refer to FIG. 5 described later).

Note that, as indicated by the chain double-dashed line in FIG. 3, a half cutter 43 configured to partially cut the above described label tape with print in the thickness direction may be provided in addition to the above described cutting mechanism 42. Of the label tape 109 with print having a five-layer structure of the cover film 103, the bonding adhesive layer, the base film, the bonding adhesive layer, and the separation sheet in the previously described example, the half cutter 43 cuts all layers other than the separation sheet, that is, the cover film 103, the bonding adhesive layer, the base film, and the bonding adhesive layer, for example.

Note that, as shown in FIG. 2, a battery storage part 70 capable of storing a plurality of various batteries BT (refer to FIG. 4 described later) having the same outer shape but different nominal voltage, such as an alkaline manganese dioxide battery or a nickel-metal hydride battery, for example, is provided adjacent to the cartridge holder 9, rearward from and on the lower side of the print label producing apparatus 1. Further, in FIG. 2, reference numeral 60 denotes a DC jack to which the output plug of an AC adapter 220 (refer to FIG. 4 described later) serving as an external power source is connected.

Control System

Next, the control system of the print label producing apparatus 1 will now be described with reference to FIG. 4.

Figure 4:
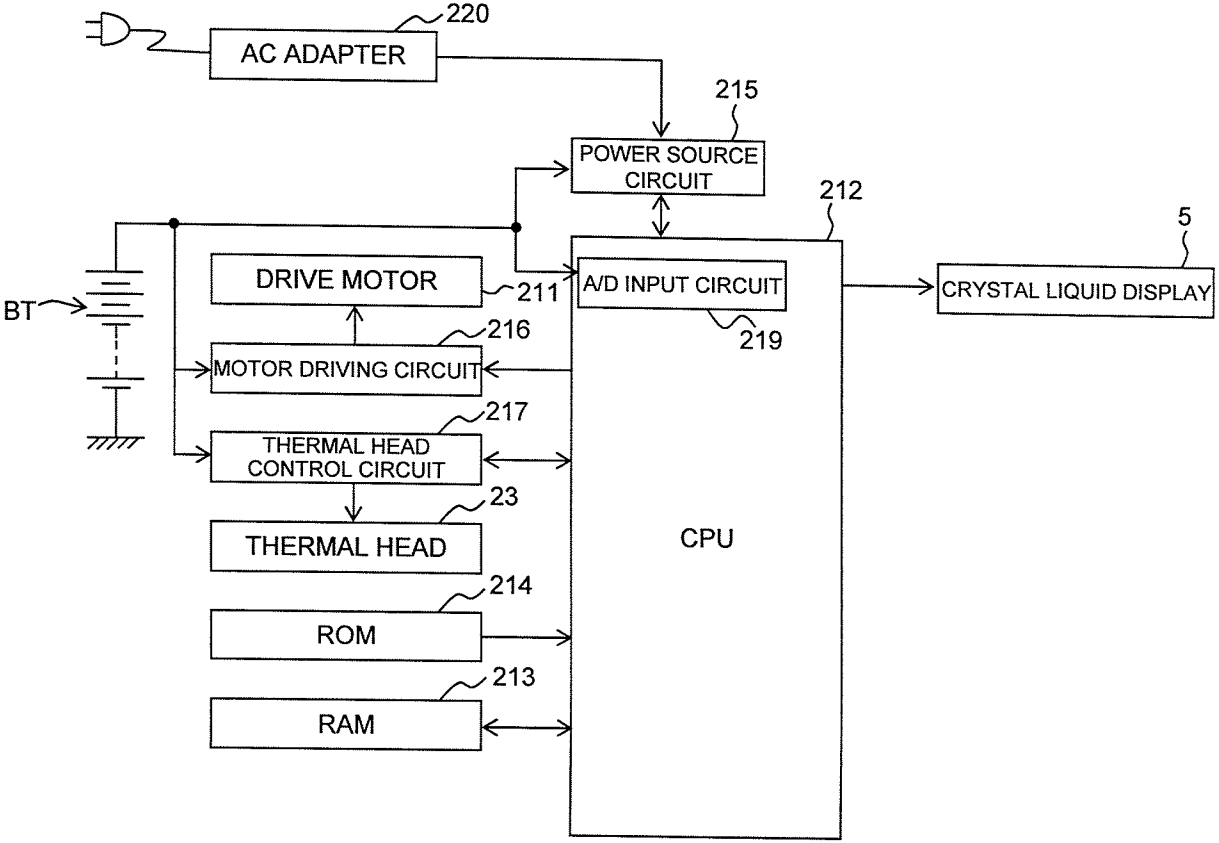
FIG. 4 is a functional block diagram showing the control system of the print label producing apparatus.

In FIG. 4, the print label producing apparatus 1 has a CPU 212 constituting a computing part that performs predetermined computations.

The CPU 212 is connected with a power source circuit 215 that is connected to the AC adapter 220 and performs the ON/OFF processing of the power source of the print label producing apparatus 1, a motor driving circuit 216 that controls the drive of the drive motor 211 that drives the above described feeding roller driving shaft 108, and the thermal head control circuit 217 configured to control the energization of the heating elements of the above described thermal head 23.

At this time, an A/D input circuit 219 for measuring (detecting) the output voltage value of the battery BT is provided to the CPU 212. A positive output terminal of the battery BT stored in the above described battery storage part 70 is connected to this A/D input circuit 219. A negative output terminal of the battery BT is connected to a ground (0 V) that serves as standard for electric potential.

Furthermore, the above described crystal liquid display 5, a ROM 214, and a RAM 213 are connected to the CPU 212. The ROM 214 stores a control program for executing determination procedures (procedures shown in FIG. 10 and FIG. 11 described later) of the type and consumption state of the battery BT. The RAM 213 (or the ROM 214) stores at least one type determination threshold value (details described later) predetermined to determine the type of the battery BT, a consumption level determination threshold value (details described later) used to determine the consumption state of the battery BT, and the like. This CPU 212 performs signal processing in accordance with a program stored in advance in the above described ROM 214 while utilizing a temporary storage function of the above described RAM 213, and controls the entire print label producing apparatus 1 accordingly.

Special Characteristics of this Embodiment

In the above basic configuration, the special characteristics of this embodiment lie in the detection of the type and consumption level of the battery BT by the behavior of the output voltage value of the battery BT. The following describes the details of the functions of the above described detection technique of this embodiment in order.

Necessity of Battery Type and Consumption Level Determination

That is, the battery BT of a plurality of types in the battery storage part 70 previously described is sometimes suitably replaced and used. In such a case, the nominal voltage and discharge characteristics differ according to the type of the battery BT, requiring operation settings to be set in accordance with the battery BT to be used in order to ensure smooth operation of the print label producing apparatus 1. In a case where the operator manually inputs the type of the battery BT as needed, the operation burden is cumbersome and the possibility of mistaken input also exists. Further, the battery BT is consumed with repeated use, increasing internal resistance. Accordingly, the type of the battery BT and whether or not the battery BT has been consumed are preferably automatically identified on the print label producing apparatus 1 side.

Here, in the print label producing apparatus 1 of this embodiment wherein the battery BT operates as a drive source, the output voltage value of the battery BT changes during the generation of a single print label L. In this embodiment, a voltage value V of the output terminal of the battery BT is detected by the above described A/D input circuit 219. Then, the fluctuation in the output voltage value V of this battery BT is used to determine the above described type and consumption level of the battery BT. The principles of that technique will now be described with reference to FIGS. 5-8.

Technique Principles of this Embodiment

Figure 5:
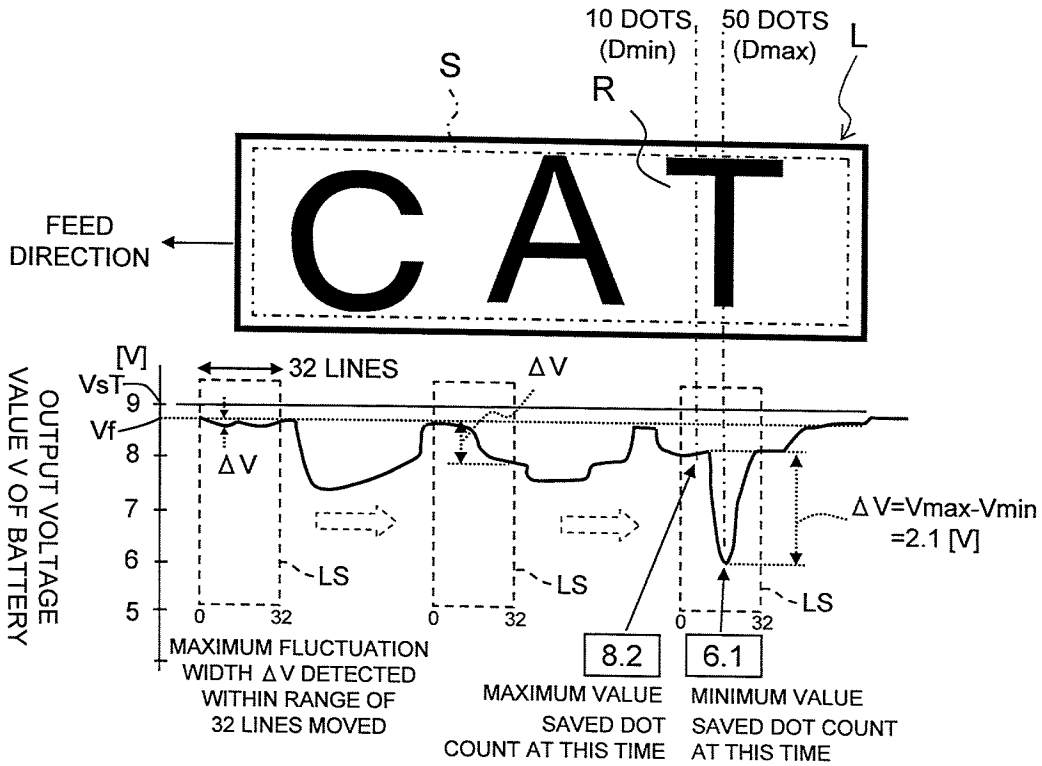
FIG. 5 is a conceptual explanatory view explaining an example of battery voltage fluctuation when a single print label is produced.

FIG. 5 shows an example of the fluctuation of the above described output voltage value in a case where print is formed on the cover film 103, producing the print label L as previously described. In FIG. 5, in a state (standby state) where neither the tape feeding by the above described feeding roller driving shaft 108 nor the printing by the thermal head 23 is performed, the output voltage of the battery BT is a relatively high voltage Vst. When production of the print label L is started, first the feeding roller driving shaft 108 is driven, feeding the cover film 103, etc. (feeding state). As a result of this feeding load, the output voltage of the battery BT changes to a somewhat decreased voltage Vf. This state continues throughout the period in which the thermal head 23 faces the area (front margin) in front of the area where the plurality of heating elements of the thermal head 23 is actually energized and printing is started, within a print area S set as the area where the preferred characters R ("CAT" in this example) are to be formed during production of the print label L.

Then, when feeding further proceeds, the plurality of heating elements of the thermal head 23 are energized and dots are formed, thereby starting the printing of the preferred drawing and characters corresponding to the print data. According to this example, first an alphabetic character "C" of the text is printed, then an alphabetic character "A" of the text is printed after an inter-character space, and then an alphabetic character "T" of the text is printed after an inter-character space, as previously described. The output voltage value V of the battery BT during printing when the printing of the drawings and characters is thus performed fluctuates in accordance with the form of the characters to be printed. That is, the load relatively increases at the timing when a dot count D equivalent to the energized heating elements of the plurality of heating elements arranged along the direction orthogonal to the feed direction (the up-down direction in FIG. 5) is high, causing the output voltage value V of the battery BT during printing to become relatively low. Conversely, the load decreases at the timing when the dot count D is low, causing the output voltage value V of the battery BT during printing to become relatively high. The degree of fluctuation of the output voltage value V based on the magnitude of this dot count D, i.e., the fluctuation value of the output voltage value V per dot, differs according to the type of the battery BT and the consumption level of the battery BT, respectively. This processing will now be described with reference to FIGS. 6-8.

Example of Output Voltage Value Fluctuation

Here, the above described voltage fluctuation value per dot can be expressed by the linear correlation of the dot count D energized by the thermal head 23 and the output voltage value V of the battery BT.

Behavior Example of the Alkaline Manganese Dioxide Battery

Figure 6:
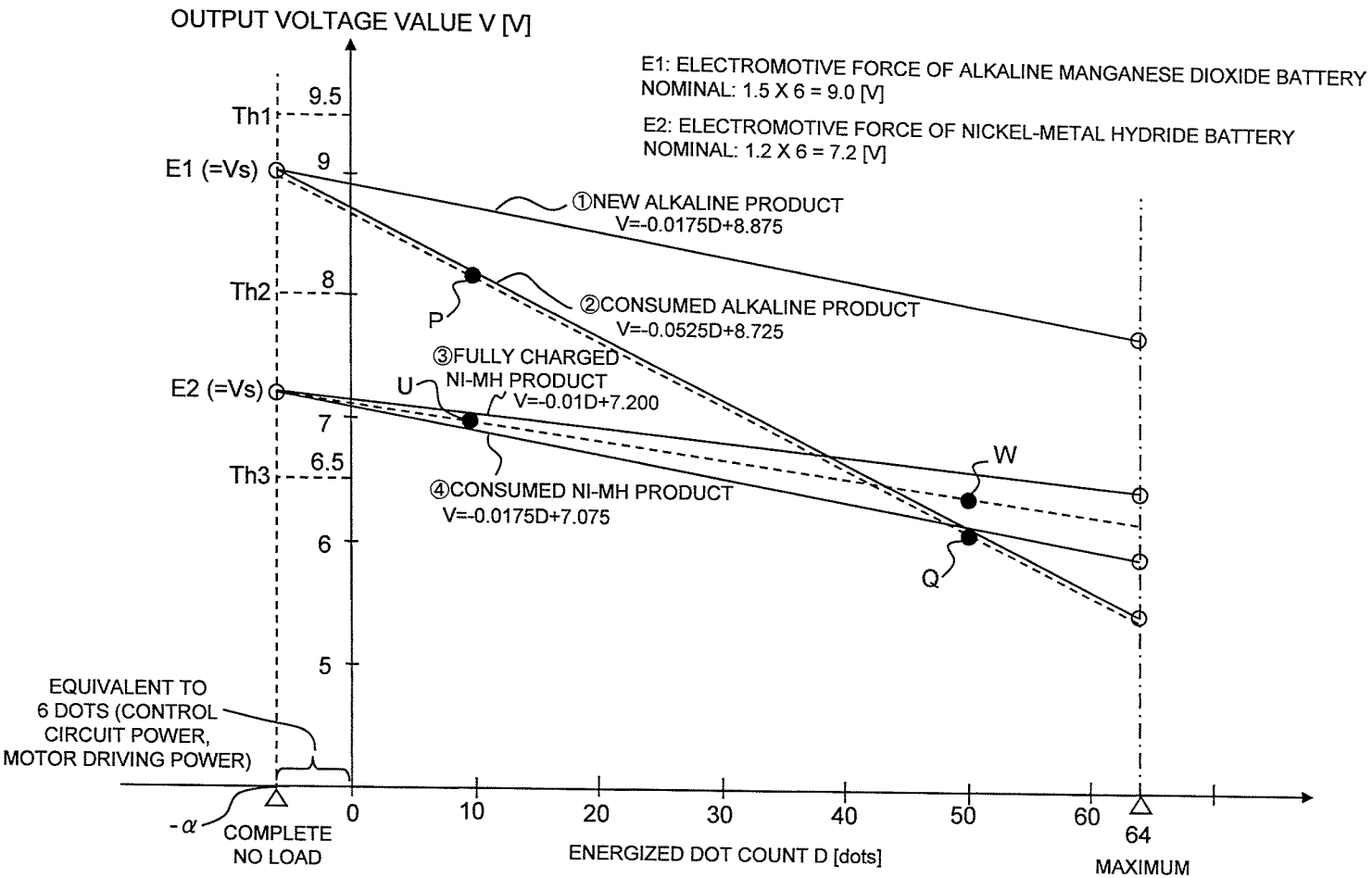
FIG. 6 is a diagram showing the fluctuation behavior of the output voltage value with respect to the energized dot count for an alkaline manganese dioxide battery and a nickel-metal hydride battery.

For example, in FIG. 6 which shows the above described dot count D on the horizontal axis (axis D) and the above described output voltage value V on the vertical axis (axis V), the above described voltage fluctuation characteristics in a case where six alkaline manganese dioxide batteries (new products) having a nominal voltage of 1.5 [V] per battery are used (total voltage: 9.0 [V]) can be expressed by the following equation given that the above described linear correlation is expressed as V=aD+b, where a=−0.0175 and b=8.875:

$$V=-0.0175D+8.875 \qquad \text{Line (1)}$$

On the other hand, when the alkaline manganese dioxide batteries that indicate characteristics such as those described above in new products (unused products) are consumed with use, the output voltage value V suddenly decreases due to the increase in internal resistance (in other words, the absolute value of the value of the above described a increases, and the degree of the downward diagonal to the right increases). According to the example of the consumed alkaline manganese dioxide batteries shown in FIG. 6, then a=−0.0525 and b=8.725, that is:

$$V=-0.0525D+8.725 \qquad \text{Line (2)}$$

At this time, the voltage value Vs at the point where the above described two lines (1) and (2) intersect in FIG. 6 is equivalent to the above described nominal voltage 1.5×6=9 [V], which is an electromotive force E1 of the alkaline manganese dioxide battery. Note that the position of this intersection point on the horizontal axis is the position where D=−α, which is the value obtained after subtracting the power consumed for control circuits, such as the above described CPU 212, etc., as well as the amount of power consumed for the above described drive motor 211 (equivalent to 6 dots upon conversion to the heating elements of the thermal head 23 in this example), from the position where the above described energized dot count D=0. In other words, this position is equivalent to a time equivalent to no load (described later) when there is no power supply to the motor driving circuit 216 or the thermal head control circuit 217.

Accordingly, in a case where the type of the battery BT stored in the battery storage part 70 of the above described print label producing apparatus 1 is unknown, it can be determined that the battery BT is an alkaline manganese dioxide battery if two combinations of the above described dot count D and output voltage value V are actually acquired, the line obtained when those two points are plotted and connected is extended to the minus side in the D axis direction, and the voltage value V near the above described intersection point (D=−α) is close to 9.0 [V] when the print label L is produced using the battery BT.

Behavior Example of the Nickel-Metal Hydride Battery

Further, in FIG. 6, the above described voltage fluctuation characteristics in a case where six nickel-metal hydride batteries (fully charged products) having a nominal voltage of 1.2 [V] per battery (total voltage: 7.2 [V]) are used can be expressed by the following equation given that the linear correlation is expressed as V=aD+b similar to the above, where a=−0.01 and b=7.200:

$$V=-0.01D+7.200 \qquad \text{Line (3)}$$

On the other hand, when the nickel-metal hydride batteries that indicate characteristics such as described above in a fully charged product are consumed with use, the output voltage value V suddenly decreases according to the increase in internal resistance similar to the above. According to the example of the consumed nickel-metal hydride batteries shown in FIG. 6, then a=−0.0175 and b=7.075, that is:

$$V=-0.0175D+7.075 \qquad \text{Line (4)}$$

Then, at this time, the voltage value Vs at the point where the above described two lines (3) and (4) intersect in FIG. 6 is equivalent to the above described nominal voltage 1.2×6=7.2 [V], which is an electromotive force E2 of the nickel-metal hydride battery, similar to the above.

Accordingly, similar to the above, in a case where the type of the battery BT stored in the battery storage part 70 is unknown, it can be determined that the battery BT is a nickel-metal hydride battery if two combinations of the above described dot count D and the output voltage value V are plotted, the line obtained by connecting the two points is extended to the minus side in the D axis direction, and the value of the coordinate V near the above described intersection point is close to 7.2 [V] when the print label L is produced using the battery BT.

Drawing a Line by Plotting Two Points

Returning to FIG. 5, according to this embodiment, a maximum fluctuation width ΔV=Vmax−Vmin of the output voltage value V within a predetermined time range is sequentially detected during the generation of the single print label L in order to obtain the two points (the two combinations of the dot count D and the output voltage value V) plotted for line generation in the above described FIG. 6. The predetermined time range is set based on a maximum energization count of the plurality of heating elements of the thermal head 23. Namely, in this example, the maximum energization count of the plurality of heating elements of the thermal head 23 is 64 dots. Therefore, a single text character is found to be configured by 64 dots square. Accordingly, the predetermined time range is set to 32 lines equivalent to half of a single text character of 64 dots (64 lines) in this example. That is, in the example shown in FIG. 5, a range LS of the above described 32 lines is set while moving rightward in the figure over time in association with the generation of the print label L, and a maximum voltage value Vmax and a minimum voltage value Vmin of the output voltage value V corresponding to the magnitude of the dot count D within the range LS are detected at each timing. The above described maximum fluctuation width ΔV=Vmax−Vmin is continually calculated using the maximum voltage value Vmax and minimum voltage value Vmin.

Then, in this embodiment, the combinations of the dot count D and the output voltage value V when generation of the single print label L is completed and when the maximum value of the above described maximum fluctuation width ΔV sequentially calculated by the movement of the above described range LS up to that time is obtained are used. In this example, the above described ΔV detected in the above described range LS before and after the timing when the alphabetic character "T" of the text is formed into print is employed. That is, the above described maximum fluctuation width ΔV=Vmax−Vmin=2.1 [V], which is the difference between the maximum voltage value Vmax=8.2 [V] used when finding a relatively low dot count Dmin=10 [dots], and the minimum voltage value Vmin=6.1 [V] used when finding a relatively high dot count Dmax=50 [dots] in the above described range LS, is identified as the maximum value of the above described maximum fluctuation width ΔV.

Type Determination

Then, the dot count Dmax=50 [dots] and the maximum voltage value Vmax=8.2 [V], and the dot count Dmin=10 [dots] and the minimum voltage value Vmin=6.1 [V], which are used to find the above described maximum fluctuation width ΔV at this time, are stored in the RAM 213. In FIG. 6, the position where the above described Dmin=10 and Vmax=8.2 is point P, the position where the above described Dmax=50 and Vmin=6.1 is point Q, and the line PQ that connects these passes near the intersection point of the above described line (1) and line (2). Accordingly, the type of the battery BT which indicates the behavior shown in FIG. 5 is determined to be the alkaline manganese dioxide battery.

To actually compute the above described determination, the CPU 212 calculates the voltage fluctuation value per dot (−0.0525 [V/dot]) by dividing the difference ΔV=2.1 [V] between the output voltage values V of the above described first timing and the above described second timing during generation of the single print label L by the difference D (Dmax−Dmin=40 dots) of the dot counts D of the above described two timings. As a result, a of the above described V=aD+b is determined to be a=−0.0525, and the linear correlation becomes:

$$V=-0.0525D+b$$

The value of the corresponding output voltage value V can be obtained by substituting D=−α, making it possible to determine whether or not this V is in a predetermined range near 9 [V] and, accordingly, whether or not the battery BT is an alkaline manganese dioxide battery.

Note that, in a case where there are two points plotted as previously described, such as points U and W in FIG. 6, for example, the line UW connecting these passes near the intersection point of the above described lines (3) and (4). Accordingly, the type of the battery BT that indicates such behavior is determined to be the nickel-metal hydride battery. For the actual computation, similar to the above, the CPU 212 determines a of the above described V=aD+b by dividing the difference ΔV of the output voltage values V of the above described first and second timings during generation of the single print label L by the difference D of the dot counts D of the above described two timings, and calculating the voltage fluctuation value per dot. Then, it can be determined whether or not the value of the output voltage value V obtained by substituting D=−α is within the predetermined range near 7.2 [V] and, accordingly, whether or not the battery BT is a nickel-metal hydride battery.

According to this embodiment, to determine whether or not the battery BT is the alkaline manganese dioxide battery or the nickel-metal hydride battery based on the above, there are provided three threshold values Th1, Th2, and Th3 related to the above described output voltage values 9 [V] and 7.2 [V]. Specifically, in this example, the above described threshold values are set to Th1=9.5 [V], Th2=8 [V], and Th3=6.5 [V]. Each of these values is stored in the ROM 214 (or an EEPROM, etc., separately provided).

Consumption Level Determination

As described above, as consumption of the battery BT advances from the new product (fully charged product) state, the absolute value of a (negative value) of the above described linear correlation V=aD+b and the downward diagonal degree to the right increase. According to this embodiment, once the type of the battery BT is determined as previously described (or when the type of the battery BT is originally known as well), it is possible to use such behavior to determine the consumption level of the battery BT.

Determination of Consumption of the Alkaline Manganese Dioxide Battery

That is, in the case of the above described alkaline manganese dioxide battery, as shown in FIG. 7, the voltage value Vt at the time equivalent to maximum load (assumed as the case where the dot count D=64 [dots] previously described as an example according to this embodiment) of the new product (unused product) expressed by the following as described above becomes VA in FIG. 7:

$$V=-0.0175D+8.875 \quad \text{Line (1)}$$

On the other hand, the voltage value Vt at the above described time equivalent to maximum load of the consumed product expressed by the following as described above becomes VB in FIG. 7:

$$V=-0.0525D+8.725 \quad \text{Line (2)}$$

As previously described, the battery BT behaves in such a manner that the downward diagonal degree to the right increases as consumption advances. Accordingly, when the battery BT stored in the battery storage part 70 of the above described print label producing apparatus 1 is used to produce the print label L, the consumption level of the battery BT can be determined as low (close to a new product) or high if two combinations of the above described dot count D and the output voltage value V are actually acquired, the line obtained by plotting and connecting the two points is extended to the plus side in the D axis direction, and the output voltage value Vt at the above described time equivalent to maximum load (D=64) is near the above described VA or near the above described VB, respectively. According to this embodiment, to assess and display the consumption level in three stages as described later, two threshold values Th4 and Th5 (consumption level determination threshold values) are provided to equally divide the section between the above described VA and VB by three, separating the section into the following three:

VA≥Vt>Th4 . . . First alkaline section

Th4≥Vt≥Th5 . . . Second alkaline section

Th5>Vt≥VB . . . Third alkaline section

Specifically, in this example, the above described voltage value VA is set to 7.75 [V], for example, and the above described voltage value VB is set to 5.50 [V], for example, so that the single print label L can be generated at a predetermined print quality, at the very least. Further, the above described threshold values Th4 and Th5 are set to 7.00 [V] and 6.25 [V], respectively. Each of these values VA, VB, Th4, and Th5 is stored in the ROM 214 (or the EEPROM, etc., separately provided). Note that the voltage value VB is a minimum voltage value predetermined so as to ensure that one print label L at a predetermined print quality at the very least is generated by means of the battery BT that is consumed.

Determination of Consumption of the Nickel-Metal Hydride Battery

On the other hand, in the case of the above described nickel-metal hydride battery, as shown in FIG. 8, the voltage value Vt at the time equivalent to maximum load (assumed as the case where the dot count D=64 [dots] similar to the above) of a fully charged product expressed by the following as described above becomes VA in FIG. 8:

$$V=-0.01D+7.200 \quad \text{Line (3)}$$

On the other hand, the voltage value Vt at the above described time equivalent to maximum load of the consumed product expressed by the following as described above becomes VB in FIG. 8:

$$V=-0.0175D+7.075 \quad \text{Line (4)}$$

Similar to the aforementioned, when the battery BT is used to produce the print label L, the consumption level of the battery BT can be determined as low (close to a fully charged product) or high if two combinations of the above described dot count D and the output voltage value V are plotted, the line obtained by connecting the two points is extended to the plus side in the D axis direction, and the output voltage value Vt at the above described time equivalent to maximum load (D=64) is near the above described VA or near the above described VB, respectively. In the case of the nickel-metal hydride battery as well, similar to the above, to assess and display the consumption level in three stages as described later, the two threshold values Th4 and Th5 are provided to equally divide the section between the above described VA and VB by three, separating the section into the following three:

VA≥Vt>Th4 . . . First nickel-metal hydride section

Th4≥Vt≥Th5 . . . Second nickel-metal hydride section

Th5>Vt≥VB . . . Third nickel-metal hydride section

Specifically, in this example, the above described voltage value VA is set to 6.55 [V], for example, and the above described voltage value VB is set to 5.95 [V], for example, so that the single print label L can be generated at a predetermined print quality, at the very least. Further, the above described threshold values Th4 and Th5 are set to 6.35 [V] and 6.15 [V], respectively. Each of these values is stored in the ROM 214 (or the EEPROM, etc., separately provided).

Displaying the Consumption Level

Then, according to this embodiment, in a case where the battery BT is an alkaline manganese dioxide battery, the consumption level of the battery BT is determined and the corresponding display (a three-stage display indicating the consumption level in stages in this example) is performed in accordance with whether the output voltage value Vt at the above described time equivalent to maximum load (D=64) falls within the above described first alkaline section, second alkaline section, or third alkaline section. Similarly, in a case where the type of the battery BT is a nickel-metal hydride battery, the consumption level of the battery BT is determined and the corresponding display (a three-stage display indicating the consumption level in stages in this example) is performed in accordance with whether the output voltage value Vt at the above described time equivalent to maximum load (D=64) falls within the above described first nickel-metal hydride section, second nickel-metal hydride section, or third nickel-metal hydride section.

Figures 9A, 9B, 9C:
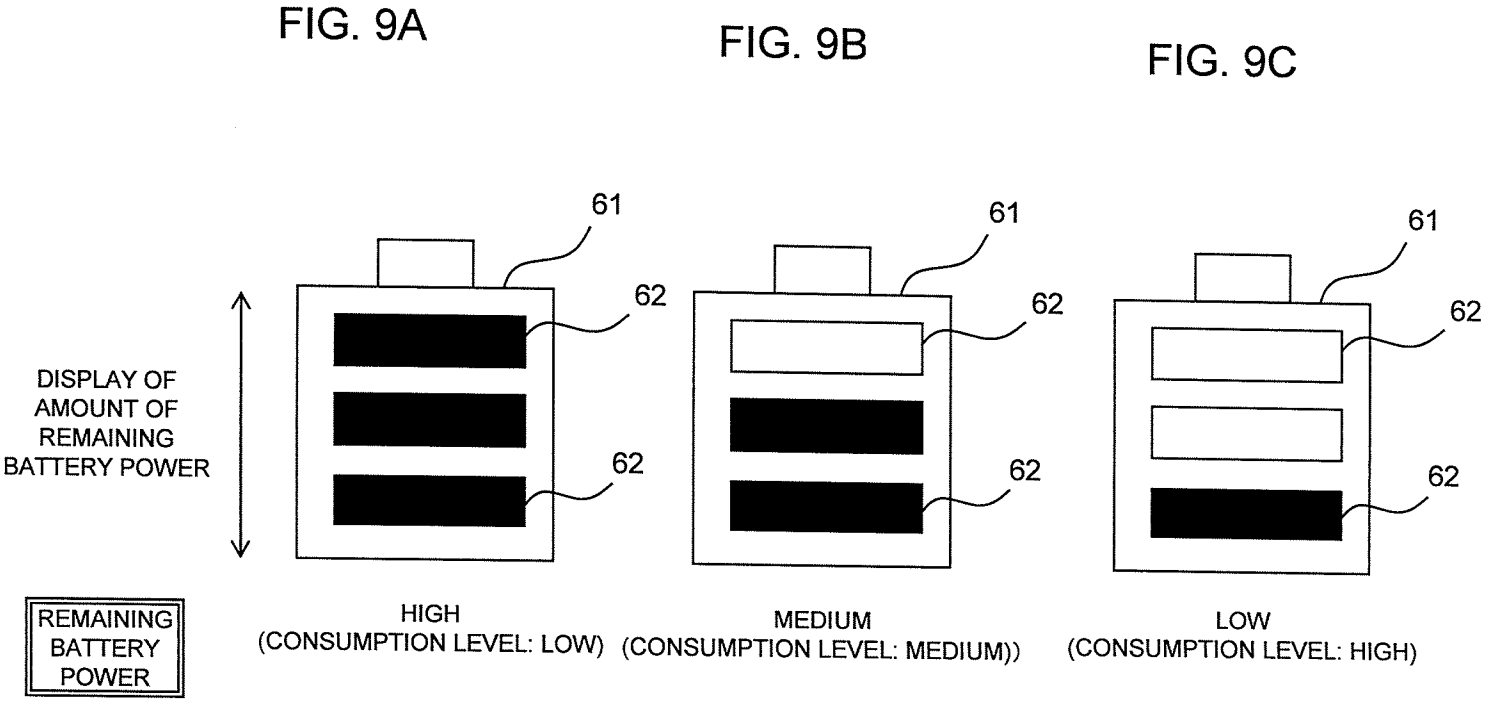
FIG. 9A is a diagram showing a display example of the consumption state of a rechargeable battery by a liquid crystal display device.
FIG. 9B is a respective example of a diagram showing a display example of the consumption state of a rechargeable battery by a liquid crystal display device.
FIG. 9C is another respective example of a diagram showing a display example of the consumption state of a rechargeable battery by a liquid crystal display device.

FIGS. 9A-9C are diagrams showing display examples of the consumption state of the battery BT via the above described liquid crystal display 5. In these FIGS. 9A-9C, the liquid crystal display 5 displays a general drawing 61 simulating the battery shape, and a remaining amount drawing 62 indicating the amount of remaining power of the battery BT as a percentage (quantity) of this general drawing 61. The remaining amount drawing 62 is expressed by a plurality of rectangular areas that exist within the outer shape of the general drawing, indicating a higher amount of remaining power of the battery BT with a larger number of rectangular areas displayed.

Figure 7:
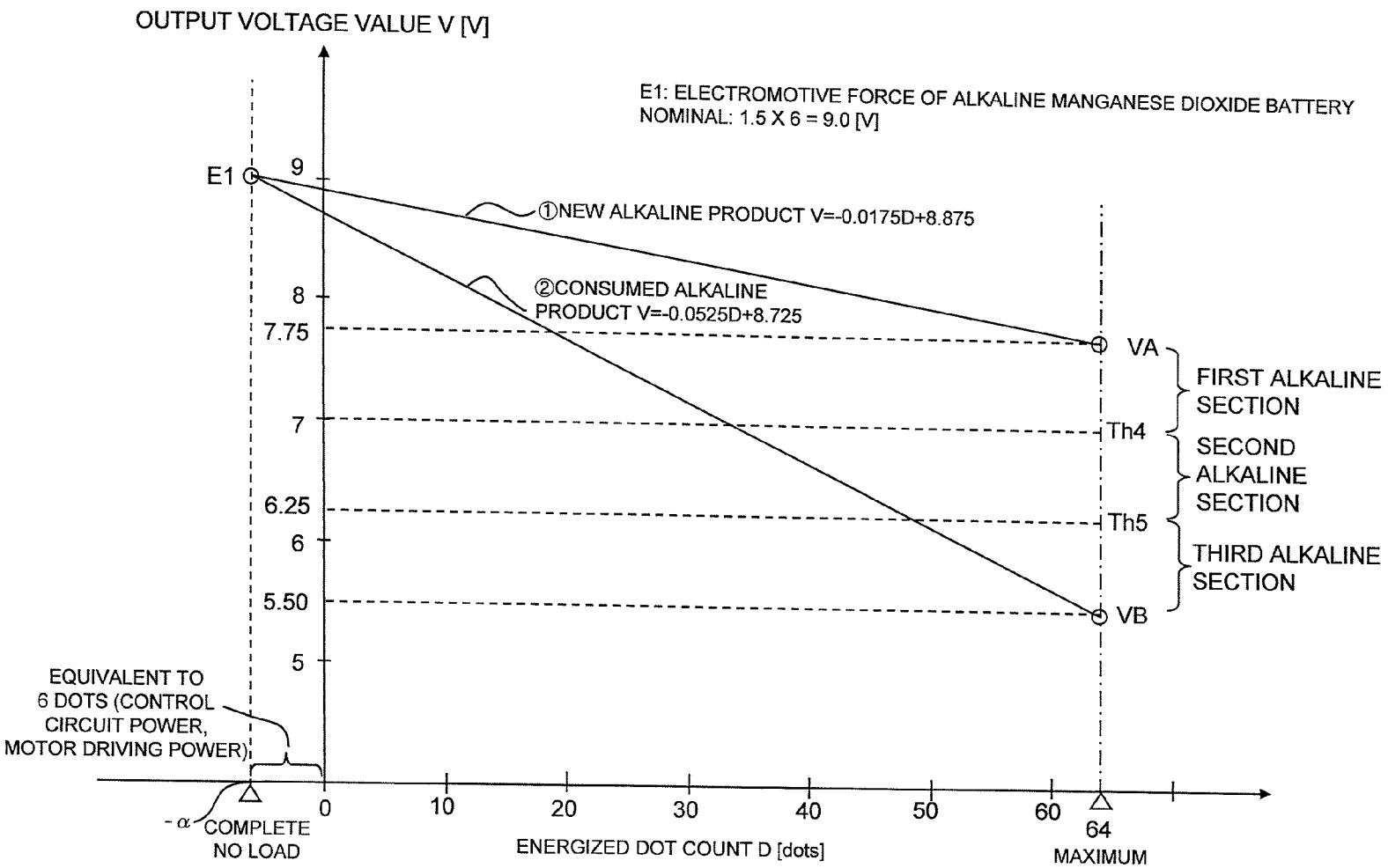
FIG. 7 is a diagram showing the fluctuation behavior of the output voltage value with respect to the energized dot count for an alkaline manganese dioxide battery.
Figure 8:
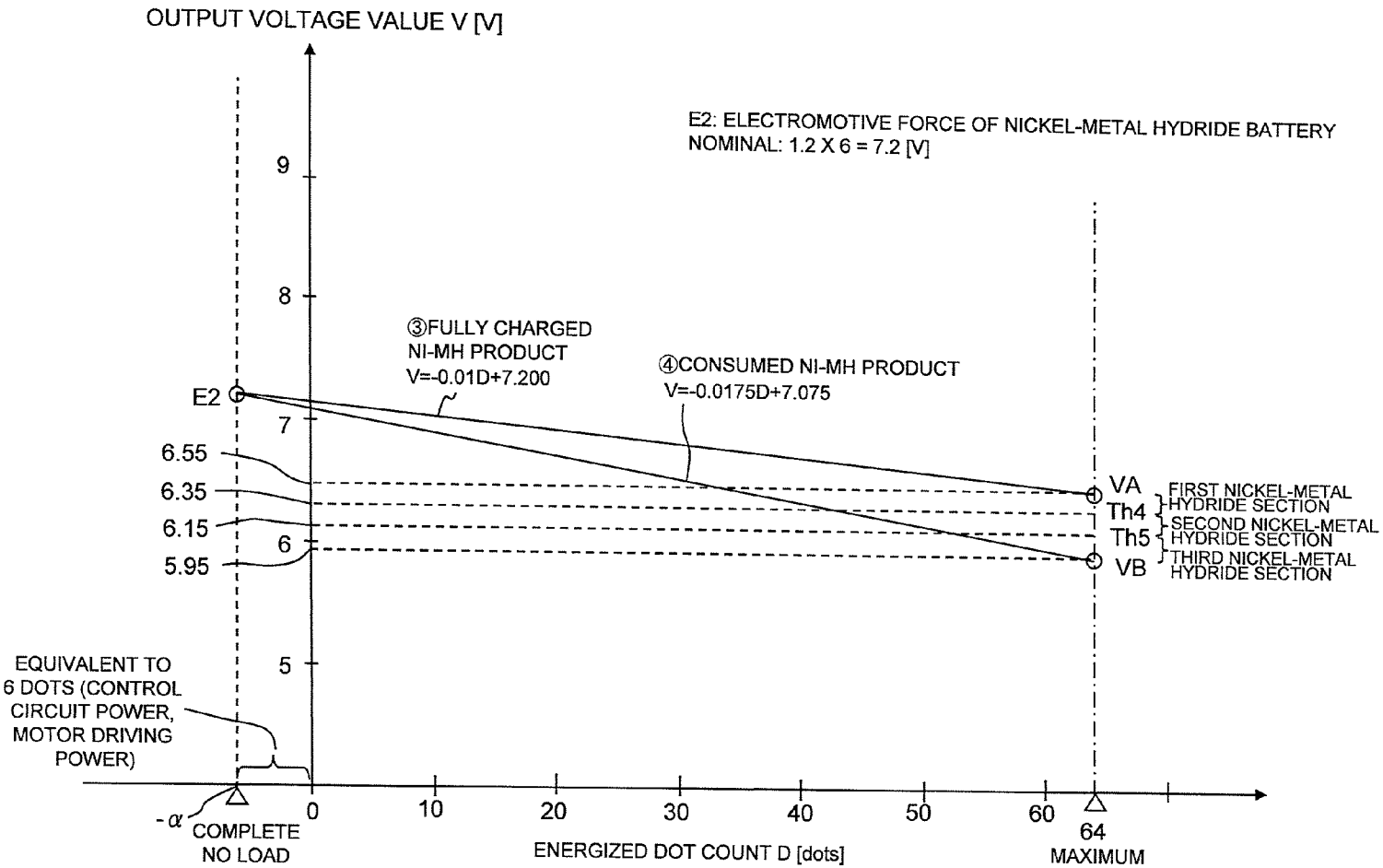
FIG. 8 is a diagram showing the fluctuation behavior of the output voltage value with respect to the energized dot count for a nickel-metal hydride battery.

The display example of FIG. 9A shows a case where the consumption level of the battery BT is sufficiently low (equivalent to the first alkaline section shown in the above described FIG. 7 or the first nickel-metal hydride section shown in the above described FIG. 8), indicating a state with a high amount of remaining power (nearly full amount).

The display example of FIG. 9B shows a case where the consumption level of the battery BT is at an intermediate level (equivalent to the second alkaline section shown in the above described FIG. 7 or the second nickel-metal hydride section shown in the above described FIG. 8), indicating a state with an intermediate amount of remaining power.

The display example of FIG. 9C shows a case where the consumption level of the battery BT is high (equivalent to the third alkaline section shown in the above described FIG. 7 or the third nickel-metal hydride section shown in the above described FIG. 8), indicating a state with a low amount of remaining power.

By expressing the consumption state of the rechargeable battery BT as a drawing in this manner, it is possible to inform the user of the consumption state of the battery BT in an intuitively easy-to-understand manner and also inform the user of the amount of remaining power of the battery BT of that consumed state.

Control Flow

Figure 10:
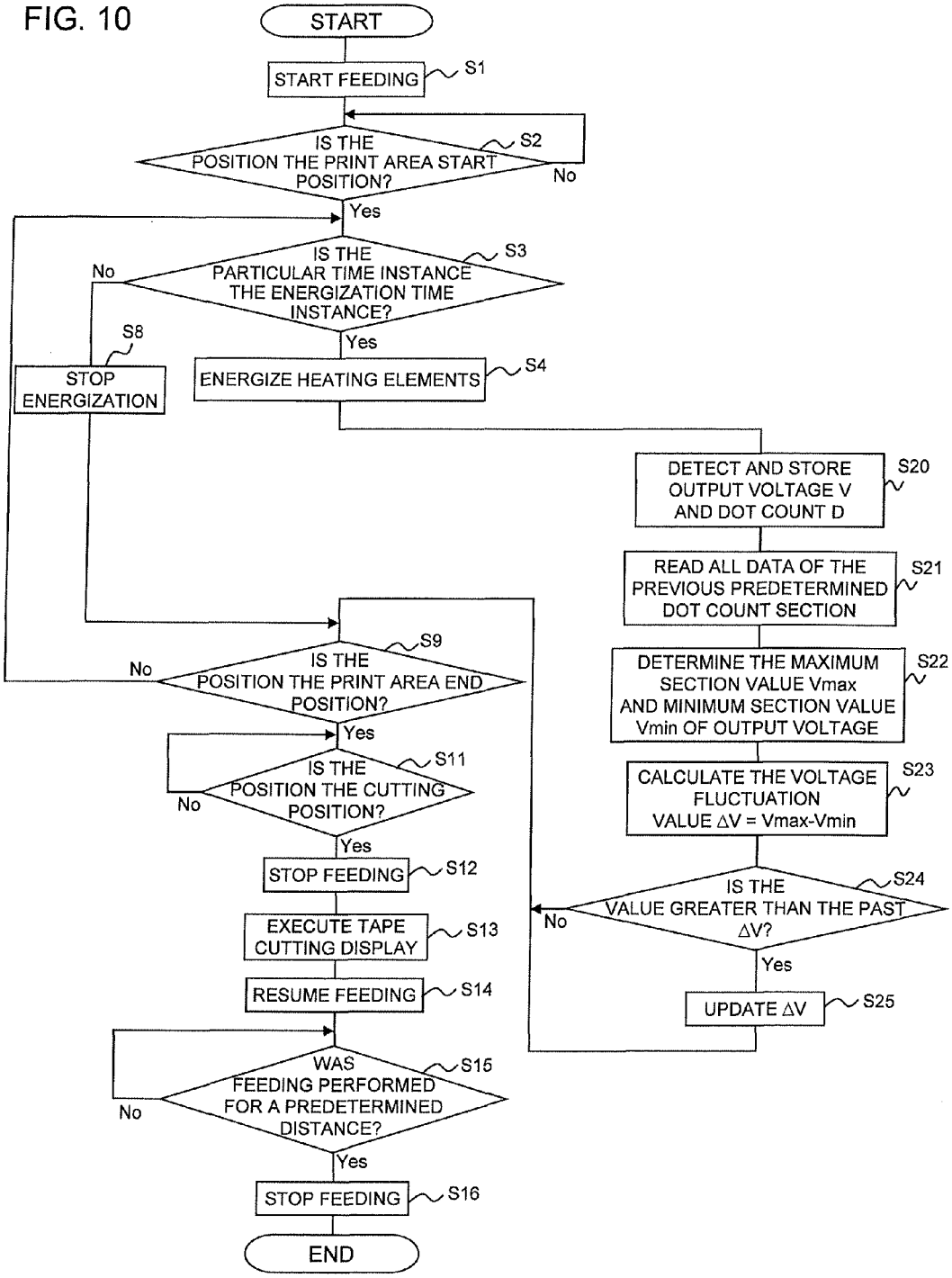
FIG. 10 is a flowchart showing a control procedure executed by the CPU.
Figure 11:
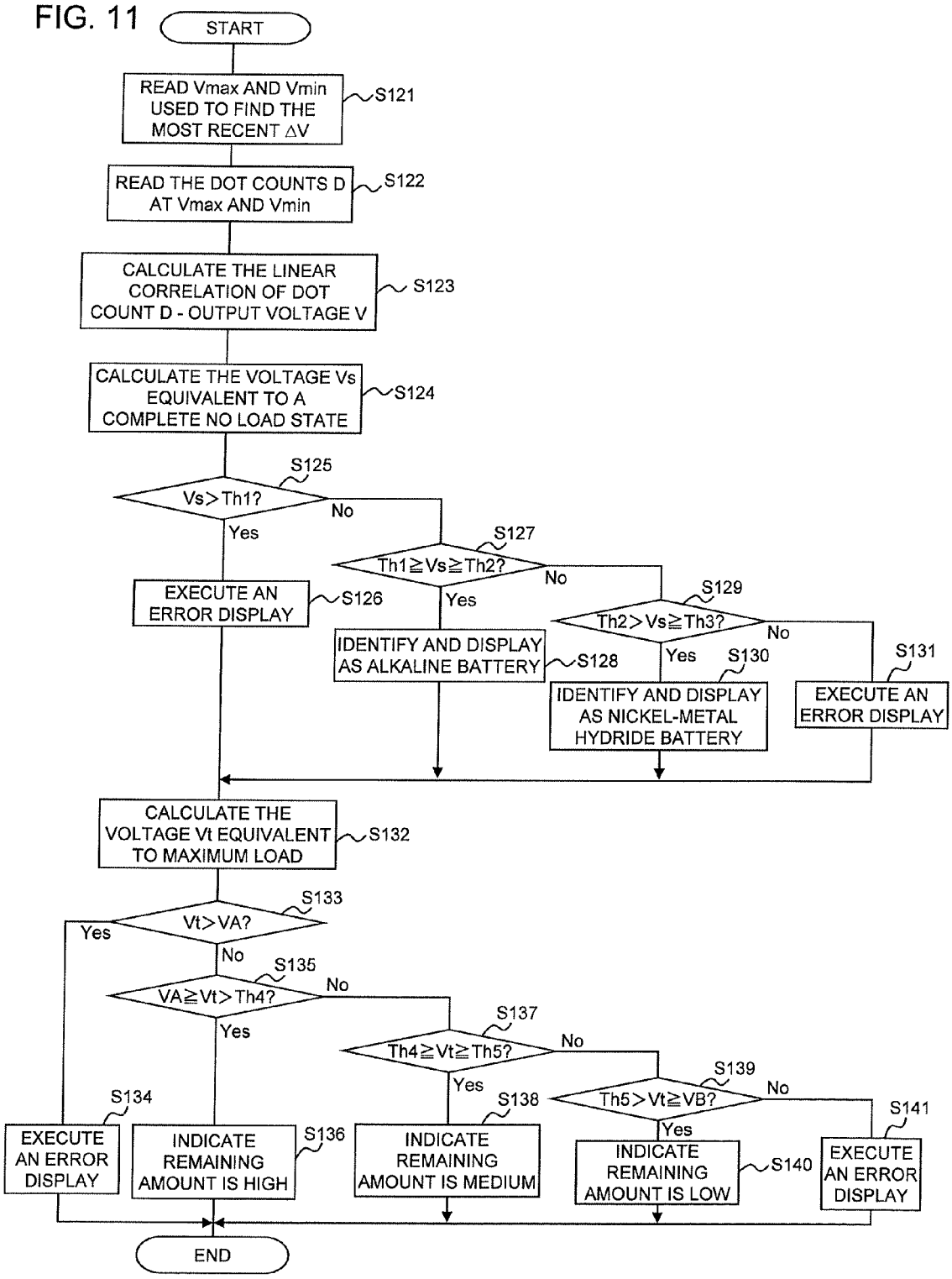
FIG. 11 is a flowchart showing a control procedure executed by the CPU.

To achieve the technique described above, the control contents executed by the CPU 212 will now be described with reference to FIG. 10 and FIG. 11. FIG. 10 is a flow showing the production process of the print label L, and FIG. 11 is a flow showing the process for determining the type and consumption level of the battery BT. Note that the procedure of the flow shown in FIG. 10 and the procedure of the flow shown in FIG. 11 are simultaneously executed based on a time-division method during the generation of the print label L. Such simultaneous parallel processing can be performed by the one CPU 212 using known methods similar to "multitask processing," which is frequently performed by an OS of a computer or the like, for example.

Print Label Production Process

In FIG. 10, the flow begins with the operator suitably operating the function key group 4 to input the characters, symbols, and the like that he or she wants to print on the print label L, and further operating the above described print key of the function key group 4 to instruct the print label producing apparatus 1 to produce the print label L, for example.

First, in step S1, the CPU 212 outputs a control signal to the motor driving circuit 216, causing the drive motor 211 to start the driving of the feeding roller driving shaft 108 and the ribbon take-up roller driving shaft 107. As a result, the feeding of the cover film 103, the base tape 101, and the label tape 109 with print (hereinafter suitably and simply "the cover film 103, etc.") is started.

Subsequently, in step S2, the CPU 212 determines whether or not the fed cover film 103, etc., was fed up to a start position of the print area S (whether or not the cover film 103, etc., was fed up to a feed direction position where the print head 23 directly faces the front end of the print area S). This determination may be made by simply using a suitable known technique, such as counting the number of pulses of the drive motor 211 comprising a stepping motor, for example. Until the cover film 103, etc., is fed up to the start position of the print area S, the decision is made that the condition of step S2 is not satisfied (S2: No), and the flow loops and enters a standby state. Once the cover film 103, etc., is fed up to the start position of the print area S, the decision is made that the condition of step S2 is satisfied (S2: Yes), and the flow proceeds to step S3.

In step S3, the CPU 212 determines whether or not the timing at this point in time is an energization timing of the heating elements of the thermal head 23, based on the print data generated by the CPU 212 by the aforementioned input of characters, symbols, etc., by the operator. That is, the timing corresponds to the above described energization timing if the feed direction position of the fed cover film 103 is one where the above described thermal head 23 is positioned within the print area S at a position where the text characters and drawings are to be printed, and does not correspond to the energization timing at any other timing. In a case where the timing does not correspond to the energization timing, the decision is made that the condition of step S3 is not satisfied (S3: No), and the flow proceeds to step S8 described later. In a case where the timing corresponds to the energization timing, the decision is made that the condition of step S3 is satisfied (S3: Yes), and the flow proceeds to step S4.

In step S4, the CPU 212 outputs a control signal to the thermal head control circuit 217, and selects and energizes the heating elements of the thermal head 23 that should generate heat at this timing in correspondence with the above described print data. With this arrangement, the ink of the ink ribbon 105 is transferred by the above described energized heating elements and the corresponding print is formed on the cover film 103. Subsequently, the flow proceeds to step S20.

In step S20, the CPU 212 stores the output voltage value V detected by the A/D input circuit 219 and the dot count D resulting from the above described heating elements at this time in the RAM 213, for example. Note that this output voltage value V is detected each time this step S20 is repeated when one of the print labels L is produced. That is, when the range LS of the aforementioned 32 lines moves in association with the generation of the print label L, the output voltage value V is always detected and accumulated in the RAM 213 in association with the dot count D at each position on the line. Subsequently, the flow proceeds to step S21.

In step S21, the CPU 212 reads all of the data (all output voltage values V respectively associated with the dot count D) of the previous predetermined dot count D section (the above described 32-line area in this example) already accumulated in the RAM 213 in step S20 as described above, from the RAM 213.

Subsequently, in step S22, the CPU 212 determines the above described maximum voltage value Vmax and minimum voltage value Vmin of all of the data of the above described predetermined dot count D section read in the above described step S21. Note that the above described maximum voltage value Vmax and minimum voltage value Vmin thus determined are stored in the RAM 213 in each case.

Subsequently, in step S23, the CPU 212 uses the maximum voltage value Vmax and minimum voltage value Vmin determined in step S22 to calculate the maximum fluctuation width ΔV=Vmax−Vmin of the difference thereof. The above described maximum fluctuation width ΔVmax thus calculated is stored in the RAM 213. Subsequently, the flow proceeds to step S24.

In step S24, the CPU 212 determines whether or not the maximum fluctuation width ΔV calculated in step S23 is greater than the past maximum fluctuation width ΔV. In a case where the value is less than or equal to the past maximum fluctuation width ΔV, the decision is made that the condition of step S24 is not satisfied (S24: No), and the flow proceeds to step S9 described later. In a case where the value is greater than the past maximum fluctuation width ΔV, the decision is made that the condition of step S24 is satisfied (S24: Yes), and the flow proceeds to step S25.

In step S25, the CPU 212 overwrites and updates the past maximum fluctuation width ΔV using the maximum fluctuation width ΔV calculated in the above described step S23. Note that the reason for using the largest maximum fluctuation width ΔV of the past by overwriting and updating the value in this manner is to ensure that, in a case where a line is drawn based on the plotting of two points and the voltages Vs and Vt are calculated as previously described, a calculation of higher precision can be achieved with a larger distance between the two points. The above described maximum fluctuation width ΔVmax thus updated is stored in the RAM 213 in the same manner as described above. Subsequently, the flow proceeds to step S9 described later.

On the other hand, in step S8 which proceeds when the decision is made that the condition of the above described step S3 is not satisfied, the CPU 212 outputs a control signal to the thermal head control circuit 217 and all of the heating elements of the thermal head 23 change to an energization stopped state. Subsequently, the flow proceeds to step S9.

In step S9, the CPU 212 determines whether or not the fed cover film 103, etc., was fed up to an end position of the print area S (whether or not the cover film 103, etc., was fed up to a feed direction position where the print head 23 directly faces the rear end of the print area S). This determination may also be made by simply using a known technique similar to the above. Until the cover film 103, etc., is fed up to the end position of the print area S, the decision is made that the condition of step S9 is not satisfied (S9: No), the flow returns to step S3, and the same procedure is repeated. Once the cover film 103, etc., is fed up to the end position of the print area S, the decision is made that the condition of step S9 is satisfied (S9: Yes), and the flow proceeds to step S11.

In step S11, the CPU 212 determines whether or not the fed cover film 103, etc., was fed up to the cutting position set on the label rear end side from the print area S based on the above described print data (whether or not the label tape 109 with print was fed up to the feed direction position where the above described movable blade 41 directly faces the above described cutting position). This determination may also be made by simply using a known technique similar to the above. If the fed cover film 103, etc., has not been fed up to the cutting position, the decision is made that the condition of step S11 is not satisfied (S11: No), and the flow loops and enters a standby state. If the cover film 103, etc., was fed up to the cutting position, the decision is made that the condition of step S11 is satisfied (S11: Yes), and the flow proceeds to step S12.

In step S12, the CPU 212 outputs a control signal to the motor driving circuit 216, causing the drive motor 211 to stop the driving of the feeding roller driving shaft 108 and the ribbon take-up roller driving shaft 107. As a result, the feeding of the cover film 103, the base tape 101, and the label tape 109 with print stops. Subsequently, the flow proceeds to step S13.

In step S13, the CPU 212 outputs a display signal to the liquid crystal display 5. With this arrangement, a suitable display that prompts the operator to operate the cutter lever 7, activate the cutting mechanism 15, and cut the label tape 109 with print is executed.

Subsequently, once the cutting of the above described label tape 109 with print is performed in accordance with the display in the above described step S13 (once the print label L is generated), the flow proceeds to step S14 where the CPU 212 outputs a control signal to the motor driving circuit 216. As a result, the drive motor 211 once again starts to drive the feeding roller driving shaft 108 and the ribbon take-up roller driving shaft 107, resuming the feeding of the cover film 103, the base tape 101, and the label tape 109 with print.

Then, in step S15, the CPU 212 determines whether or not the feeding of the cover film 103, etc., was performed in an amount equivalent to a predetermined feeding distance (a distance sufficient for discharging the above described print label L thus generated to outside the apparatus) after the feeding was resumed in the above described step S14. This determination may also be made by simply using a known technique similar to the above. If the cover film 103, etc., has not been fed a predetermined feeding distance, the decision is made that the condition of step S15 is not satisfied (S15: No), and the flow loops and enters a standby state. If the cover film 103, etc., was fed a predetermined feeding distance, the decision is made that the condition of step S15 is satisfied (S15: Yes), and the flow proceeds to step S16.

In step S16, similar to step S12, the CPU 212 outputs a control signal to the motor driving circuit 216, causing the drive motor 211 to stop the driving of the feeding roller driving shaft 108 and the ribbon take-up roller driving shaft 107. As a result, the feeding of the cover film 103, the base tape 101, and the label tape 109 with print stops. This process then terminates here.

Battery Type and Consumption Level Determination Process

In FIG. 11, first, in step S121, the CPU 212 reads the above described maximum voltage value Vmax and minimum voltage value Vmin (refer to the above described steps S22-S25) that are used to find the most recent voltage fluctuation value ΔV at this point in time from the RAM 213. Subsequently, the flow proceeds to step S122.

In step S122, the CPU 212 reads the dot counts D respectively corresponding to the maximum voltage value Vmax and minimum voltage value Vmin read in the above described step S121, from the RAM 213 (refer to the above described step S20). As a result, the maximum voltage value Vmax and the dot count Dmin, which are used to find the relatively low dot count Dmin, and the minimum voltage value Vmin and the dot count Dmax, which are used to find the relatively high dot count Dmax, are respectively associated with one another.

In step S123, the CPU 212 calculates the linear correlation between the dot count D and the output voltage value V using the above described Vmax and Vmin acquired in the above described step S121 as well as Dmin corresponding to the Vmax and Dmax corresponding to the Vmin, which were acquired in the above described step S122. That is, (Dmax, Vmin) at the maximum dot count of the above described first timing and (Dmin, Vmax) at the minimum dot count of the above described second timing of the coordinates D-V of the above described FIG. 6 are each substituted for the D and V of the above described V=aD+b to calculate the value of a, which is the slope of the line that passes through these two points, and the value of b, which is the V-intercept of the line. Subsequently, the flow proceeds to step S124.

In step S124, the CPU 212 substitutes the above described D=−α (refer to FIGS. 6-8) equivalent to a complete no load state for the D of the linear equation V=aD+b calculated in the above described step S123 to calculate the aforementioned voltage Vs equivalent to a complete no load state. Subsequently, the flow proceeds to step S125.

In step S125, the CPU 212 compares the voltage Vs acquired in the above described step S124 and the type determination threshold value Th1 stored in the ROM 214, and determines whether or not Vs>Th1. In a case where the voltage Vs is greater than the type determination threshold value Th1, the decision is made that the condition of step S125 is satisfied (S125: Yes), and the flow proceeds to step S126.

In step S126, the CPU 212 outputs a display signal to the liquid crystal display 5, and executes an error display indicating that the voltage Vs is greater than the type determination threshold value Th1 and is not a normal value. Subsequently, the flow proceeds to step S132 described later.

On the other hand, in a case where the voltage Vs is equal to or less than the type determination threshold value Th1 in the above described step S125, the decision is made that the condition of step S125 is not satisfied (S125: No), and the flow proceeds to step S127.

In step S127, the CPU 212 further compares the voltage Vs acquired in the above described step S124 and the type determination threshold value Th2 stored in the ROM 214, and determines whether or not Th1≥Vs≥Th2. In a case where the voltage Vs is greater than or equal to Th2 and less than or equal to Th1, the decision is made that the condition of step S127 is satisfied (S127: Yes), and the flow proceeds to step S128.

In step S128, the CPU 212 outputs a display signal to the liquid crystal display 5 and executes a display indicating that the battery BT used is an alkaline manganese dioxide battery. Subsequently, the flow proceeds to step S132 described later.

On the other hand, in a case where the voltage Vs is less than Th2 in the above described step S127, the decision is made that the condition is not satisfied (S127: No), and the flow proceeds to step S129.

In step S129, the CPU 212 further compares the voltage Vs acquired in the above described step S124 and the type determination threshold value Th3 stored in the ROM 214, and determines whether or not Th2>Vs≥Th3. In a case where the voltage Vs is greater than or equal to Th3 and is less than Th2, the decision is made that the condition of step S129 is satisfied (S129: Yes), and the flow proceeds to step S130.

In step S130, the CPU 212 outputs a display signal to the liquid crystal display 5 and executes a display indicating that the battery BT used is a nickel-metal hydride battery. Subsequently, the flow proceeds to step S132 described later.

On the other hand, in a case where the voltage Vs is less than Th3 in the above described step S129, the decision is made that the condition of step S129 is not satisfied (S 129: No), and the flow proceeds to step S131.

In step S131, the CPU 212 outputs a display signal to the liquid crystal display 5 and executes an error display indicating that the battery BT used is neither an alkaline manganese dioxide battery nor a nickel-metal hydride battery. Subsequently, the flow proceeds to step S132.

In step S132, the CPU 212 substitutes a predetermined value β [β=64 dots in this embodiment (refer to FIGS. 6-8)] at the time equivalent to maximum load of the thermal head control circuit 217 and the motor driving circuit 216 for D of the linear equation V=aD+b calculated in the above described step S123 to calculate the aforementioned voltage Vt equivalent to maximum load. Subsequently, the flow proceeds to step S133.

In step S133, the CPU 212 compares the voltage Vt acquired in the above described step S132 and the above described maximum voltage value VA stored in the ROM 214, and determines whether Vt>VA. In a case where Vt>VA, the decision is made that the condition of step S133 is satisfied (S133: Yes), and the flow proceeds to step S134.

In step S134, the CPU 212 outputs a display signal to the liquid crystal display 5, and executes an error display indicating that the voltage Vt is greater than the maximum voltage value VA and is not a normal value. This process then terminates here.

On the other hand, in a case where Vt>VA is not true in the above described step S133, the decision is made that the condition of step S133 is not satisfied (S133: No), and the flow proceeds to step S135.

In step S135, the CPU 212 further compares the voltage Vt calculated in the above described step S132 and the consumption level determination threshold value Th4 stored in the ROM 214, and determines whether or not VA≥Vt>Th4 (in other words, whether or not the value is to be associated with the first section). In a case where VA≥Vt>Th4, the decision is made that the condition of step S135 is satisfied (5135: Yes), and the flow proceeds to step S136.

In step S136, the CPU 212 outputs a display signal to the liquid crystal display 5 and executes a display indicating that the amount of remaining battery power of the battery BT used is high (refer to the aforementioned FIG. 9A). This process then terminates here.

On the other hand, in a case where the voltage Vt is equal to or less than the consumption level determination threshold value Th4 in the above described step S135, the decision is made that the condition of step S135 is not satisfied (S135: No), and the flow proceeds to step S137.

In step S137, the CPU 212 further compares the voltage Vt calculated in the above described step S132 and the consumption level determination threshold value Th5 stored in the ROM 214, and determines whether or not Th4≥Vt≥Th5 (in other words, whether or not the value is to be associated with the second section). In a case where Th4≥Vt≥Th5, the decision is made that the condition of step S137 is satisfied (S137: Yes), and the flow proceeds to step S138.

In step S138, the CPU 212 outputs a display signal to the liquid crystal display 5 and executes a display indicating that the amount of remaining battery power of the battery BT used is at an intermediate level (a so-called battery weak state; refer to the aforementioned FIG. 9B). This process then terminates here.

On the other hand, in a case where the voltage Vt is less than the consumption level determination threshold value Th5 in the above described step S137, the decision is made that the condition of step S137 is not satisfied (S137: No), and the flow proceeds to step S139.

In step S139, the CPU 212 further compares the voltage Vt calculated in the above described step S132 and the minimum voltage value VB stored in the ROM 214, and determines whether or not Th5>Vt≥VB (in other words, whether or not the value is to be associated with the third section). In a case where Th5>Vt≥VB, the decision is made that the condition of step S139 is satisfied (S139: Yes), and the flow proceeds to step S140.

In step S140, the CPU 212 outputs a display signal to the liquid crystal display 5 and executes a display indicating that the amount of remaining battery power of the battery BT used is low (a so-called battery empty state; refer to the aforementioned FIG. 9C). This process then terminates here.

On the other hand, in a case where the voltage Vt is less than the minimum voltage value VB in the above described step S139, the decision is made that the condition of step S139 is not satisfied (S139: No), and the flow proceeds to step S141.

In step S141, the CPU 212 outputs a display signal to the liquid crystal display 5 and executes an error display indicating that the battery BT used is neither an alkaline manganese dioxide battery nor a nickel-metal hydride battery. This process then terminates here.

Note that FIG. 12 shows examples of the specific values of the maximum voltage value VA, the minimum voltage value VB, and the consumption level determination threshold values Th4, Th5, and Th6 used in the above described steps S133, S135, S137, S139, and S141. These values are all stored in the above described ROM 214.

As shown in the figures, in this example, in a case where the battery BT is an alkaline manganese dioxide battery, the maximum voltage value VA=7.75 [V], the minimum voltage value VB=5.50 [V], and the consumption level determination threshold values Th4=7.00 [V] and Th5=6.25 [V]. Further, in a case where the battery BT is a nickel-metal hydride battery, the maximum voltage value VA=6.55 [V], the minimum voltage value VB=5.95 [V], and the consumption level determination threshold values Th4=6.35 [V] and Th5=6.15 [V].

As described above, in this embodiment, the CPU 212 finds the linear correlation between the dot count D of the thermal head 23 and the output voltage value V of the battery BT by calculating the voltage fluctuation value ΔV per dot. Then, using the above described correlation, the CPU 212 estimates the voltage value Vs of the battery BT at the time equivalent to no load when there is no power supply and the voltage value Vt of the battery BT at the time equivalent to maximum load, compares the voltage value Vs and the type determination threshold values Th1, Th2, and Th3, and compares the voltage value Vt and the consumption level determination threshold values Th4 and Th5. With this arrangement, even in a case where the type and consumption level of the battery BT stored in the battery storage part 70 are unknown, it is possible to determine the type and consumption level of the battery BT with high accuracy. That is, determining the state (type and consumption level) of the battery BT using the degree of fluctuation of the output voltage value V (the output voltage fluctuation value ΔV per dot) when the print label L is actually generated with a relatively high load applied makes it possible to achieve a result of high accuracy compared to prior art where the status of the battery BT is determined by only two voltage values, the output voltage value V at low load (or regular load) and the output voltage value V at no load. Further, the consumption level of the battery BT can be determined with high accuracy and the display of that consumption level can be executed with high accuracy. With this arrangement, it is possible to make the operator accurately and reliably aware of the current amount of remaining battery power and, in a case where the consumption level is high, accurately and reliably aware of the timing when battery replacement is required.

Further, in particular, according to this embodiment, the liquid crystal display 5 executes a predetermined display corresponding to the section affiliated with the voltage value Vt at the time equivalent to maximum load, based on the above described consumption level determination. As a result, it is possible to finely divide the consumption level of the battery BT (in other words, the amount of remaining battery power) into a plurality of stages (three stages in this example as shown in FIG. 9) and display that consumption level in an easy-to-understand manner to the operator. As a result, the convenience can be improved for the operator.

While the above employs a method wherein printing is performed on the cover film 103 separate from the base tape 101 and then the two are bonded together, the present disclosure is not limited thereto. For example, the present disclosure may also be applied to a method (a type that does not perform bonding) wherein printing is performed on the print-receiving tape layer provided to the base tape. In such a case, the base tape itself constitutes the print-receiving tape for the label as well as the print-receiving object.

Further, while the above has described an illustrative scenario in which the present disclosure is applied to the print label producing apparatus 1 as an example of the printer, the present disclosure may be additionally applied to a printer that forms graphs and prints characters on regular print-receiving paper, such as one of size A4, A3, B4, B5, etc. In each of these cases as well, the same advantages are achieved.

What is claimed is:

1. A printer comprising:

a feeder configured to feed a print-receiving object;

a thermal head comprising a plurality of heating elements configured to form dots on each print line where said print-receiving object is divided into print resolutions in a feed direction;

an energizing device configured to selectively energize said plurality of heating elements of said thermal head in accordance with print data;

a driving device configured to control a driving of said feeder;

a battery storage part configured to store a battery configured to supply power to said energizing device and said driving device;

a voltage detecting device configured to detect an output voltage value of said battery;

a display device; and a control device configured to control said energizing device and said driving device so that said thermal head forms print corresponding to the print data on said print-receiving object fed by said feeder, generating a printed object;

said control device executing:

a dot count identification process where a dot count, which is a number of said plurality of heating elements simultaneously energized by said energizing device, is identified at a first timing to provide a relatively high dot count and a second timing to provide a relatively low dot count, in a predetermined time range during generation of a single printed object via coordination of said feeder and said thermal head;

a dot voltage fluctuation value calculation process where a voltage fluctuation value per dot is calculated by dividing a difference between said output voltage value detected by said voltage detecting device at said first timing and said output voltage value detected by said voltage detecting device at said second timing by a difference between said dot count identified by said dot count identification process at said first timing and said dot count identified by said dot count identification process at said second timing;

a maximum load voltage estimation process where a voltage value of said battery is estimated at a time equivalent to maximum load for said energizing device and said driving device, based on said voltage fluctuation value per dot calculated by said dot voltage fluctuation value calculation process, said output voltage value at said first timing, and said output voltage value at said second timing;

a consumption level determination process where a consumption level of said battery is determined based on a comparison result of a voltage value at said time equivalent to maximum load estimated by said maximum load voltage estimation process and a consumption level determination threshold value determined in advance; and a display process where a predetermined display indicating a consumption level in stages is executed on said display device, based on a determination result of said consumption level determination process.

2. The printer according to claim 1, further comprising a memory configured to store at least one said consumption level determination threshold value determined to divide into a plurality of sections a section of difference between a maximum voltage value predetermined in accordance with said time equivalent to maximum load of said battery of an unused state, and a minimum voltage value predetermined so as to ensure that one said printed object at a predetermined print quality at the very least is generated by means of a consumed said battery, wherein;

it is determined, in said consumption level determination process, to which of said plurality of sections a voltage value at said time equivalent to maximum load is to be belonged, the sections being divided by said at least one consumption level determination threshold value stored in said memory, the voltage value being estimated by said maximum load voltage estimation process, and said predetermined display corresponding to said section where the voltage value at said time equivalent to the maximum load is belonged to, is executed in said display process in accordance with a determination of said consumption level determination process.

3. The printer according to claim 2, wherein:

said control device is configured to further execute:

a no load voltage estimation process where a voltage value of said battery is estimated at a time equivalent to no load when there is no power supply to said energizing device and said driving device, based on said voltage fluctuation value per dot calculated by said dot voltage calculation process; and a type determination process where a type of said battery is determined by a comparison result of the voltage value at said time equivalent to no load estimated by said no load voltage estimation process and a predetermined type determination threshold value; and it is determined, in said consumption level determination process, to which of said plurality of sections the voltage value at said time equivalent to maximum load is to be belonged by using said at least one consumption level determination threshold value predetermined for the type of said battery determined by said type determination process and stored in said memory, the sections being divided by said at least one consumption level determination threshold value, the voltage value being estimated by said maximum load voltage estimation process.

4. The printer according to claim 1, wherein:

said predetermined time range is set based on a maximum energization count of said plurality of heating elements of said thermal head.

5. The printer according to claim 4, wherein:

said predetermined time range is set to a time corresponding to substantially one-half of said maximum energization count of said plurality of heating elements of said thermal head.

* * * * *